US006443857B1

(12) United States Patent
Chuang

(10) Patent No.: US 6,443,857 B1
(45) Date of Patent: Sep. 3, 2002

(54) SHOCK-ABSORBING GOLF-CLUB HEAD

(76) Inventor: Chao-Jan Chuang, No. 2, Lane 523, Sec. 3, Chung Cheng Road, Jen Teh Hsiang, Tainan Hsien (TW)

( * ) Notice: Subject to any disclaimer, the term of this patent is extended or adjusted under 35 U.S.C. 154(b) by 0 days.

(21) Appl. No.: 09/759,417

(22) Filed: Jan. 12, 2001

(51) Int. Cl.[7] ..... A63B 53/04
(52) U.S. Cl. ..... 473/332; 473/342
(58) Field of Search ..... 473/324, 329, 473/332, 342, 349, 350, 326, 345

(56) References Cited

U.S. PATENT DOCUMENTS 2,034,936 A * 3/1936 Barnhart
2,429,351 A * 10/1947 Fetterolf
4,027,885 A * 6/1977 Rogers
4,398,965 A * 8/1983 Campau
4,523,759 A * 6/1985 Igarashi
4,664,383 A * 5/1987 Aizawa
5,078,397 A * 1/1992 Aizawa
5,301,941 A * 4/1994 Allen
5,398,929 A * 3/1995 Kitaichi
5,425,535 A * 6/1995 Gee
5,492,327 A * 2/1996 Biafore
5,766,092 A * 6/1998 Mimeur
5,772,527 A * 6/1998 Liu
5,899,821 A * 5/1999 Hsu
6,042,486 A * 3/2000 Gallagher
6,093,116 A * 7/2000 Hettinger

* cited by examiner

*Primary Examiner*—Sebastiano Passaniti
(74) *Attorney, Agent, or Firm*—Pro-Techtor International Services

(57) ABSTRACT

A shock-absorbing golf club head includes a front recess in the striking face of a golf club head, having a plurality of through holes communicating with a rear recess in order to form a shock-absorbing layer when the front recess and the rear recess are formed into shape. A metal face plate affixed to the striking face is mounted in the front recess. When shock-absorbing material is put into the front and rear recesses, a double layer for shock-absorbing is formed, thereby adding shock-absorbing, shock-lessening, and stability to the golf club head to give better ball control.

3 Claims, 7 Drawing Sheets

SHOCK-ABSORBING GOLF-CLUB HEAD

BACKGROUND OF THE INVENTION

This invention relates to a shock-absorbing golf club head, particularly to one having a double-deck shock-absorbing layer to effectively absorb wrenching and shock force caused by hitting to achieve effective shock-absorbing, shock-lessening, and stability of ball-controlling.

Generally, when a golfer swings a golf club in striking a ball, the striking face of the golf club will give rise to a kind of wrenching and shock force, which may hurt a golfer's wrists.

In order to eliminate such drawbacks, some conventional golf club heads are integrally provided with a shock-absorbing layer for absorbing the wrench and shock force caused by hitting. U.S. Pat. No. 5,772,527 is a typical example.

In accordance with U.S. Pat. No. 5,772,527, the striking face 21 of a golf club head 2 is provided with a recess 22 having projections 23 around a front circumferential edge to be fixedly mounted with a metal face plate 25 by welding, sealing the recess 22 and forming an intermediate hollow with a slot 24 on an upper edge for injecting shock-absorbing material into the recess 22 to form a shock-absorbing layer 1, as shown in FIGS. 1, 2, and 3.

However, the wrench and shock force of a golf club head caused by hitting takes place instantly and spreads so quickly that it can hardly be absorbed completely by the single shock-absorbing layer inside the striking face of the golf club head.

SUMMARY OF THE INVENTION

The objective of this invention is to offer a golf club head having a double layer for shock absorbing, able to effectively absorb the wrench and shock force caused by hitting, enabling a golfer to acquire stability of ball controlling.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
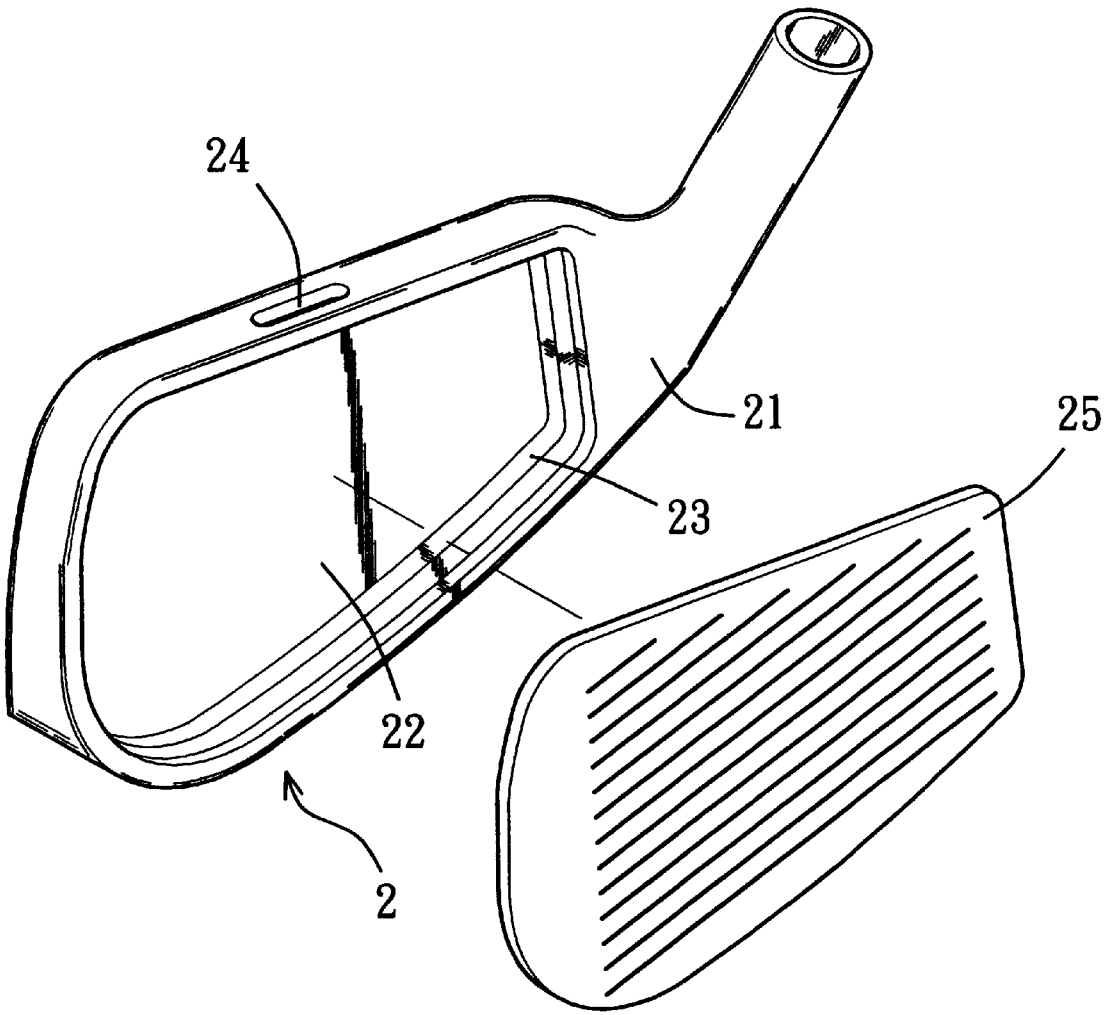
FIG. 1 (PRIOR ART)
FIG. 1 is a perspective view or a known conventional golf club head with a metal faceplate separated.
Figure 3:
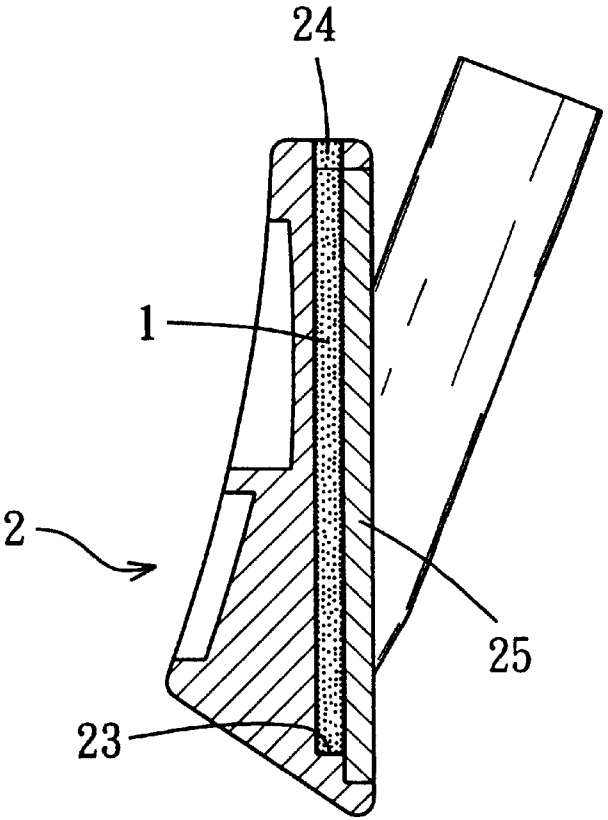
FIG. 3 (PRIOR ART)
FIG. 3 is a side cross-sectional view of the known conventional golf club head.
Figure 2:
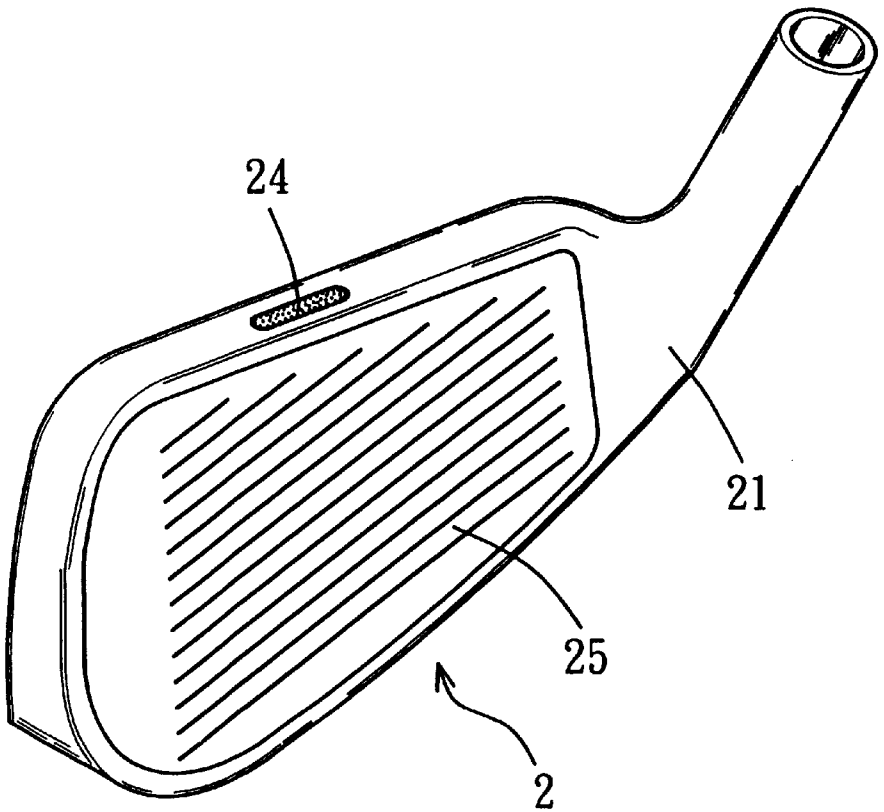
FIG. 2 (PRIOR ART)
FIG. 2 is a perspective view of the known conventional golf club head.
Figure 4:
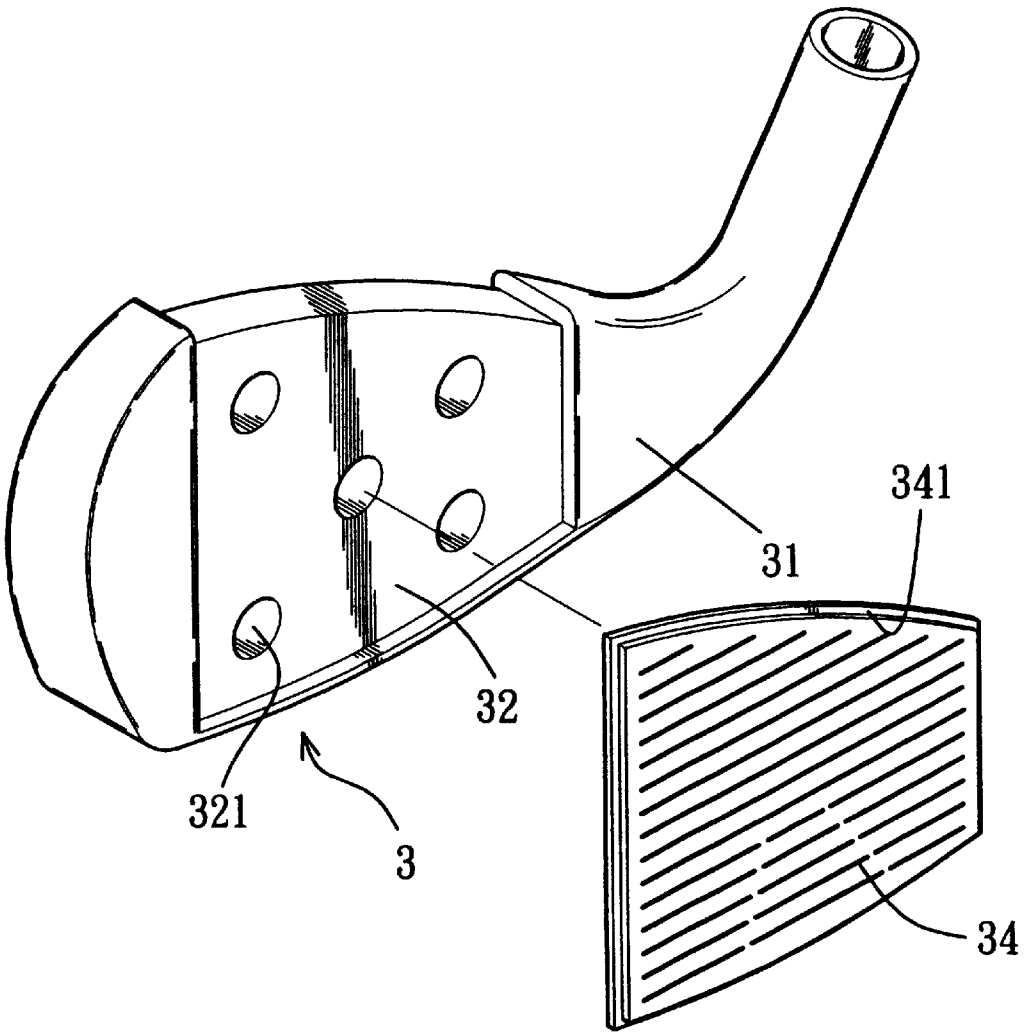
FIG. 4 is an exploded perspective view of a golf club head with a metal faceplate separated in the present invention.
Figure 5:
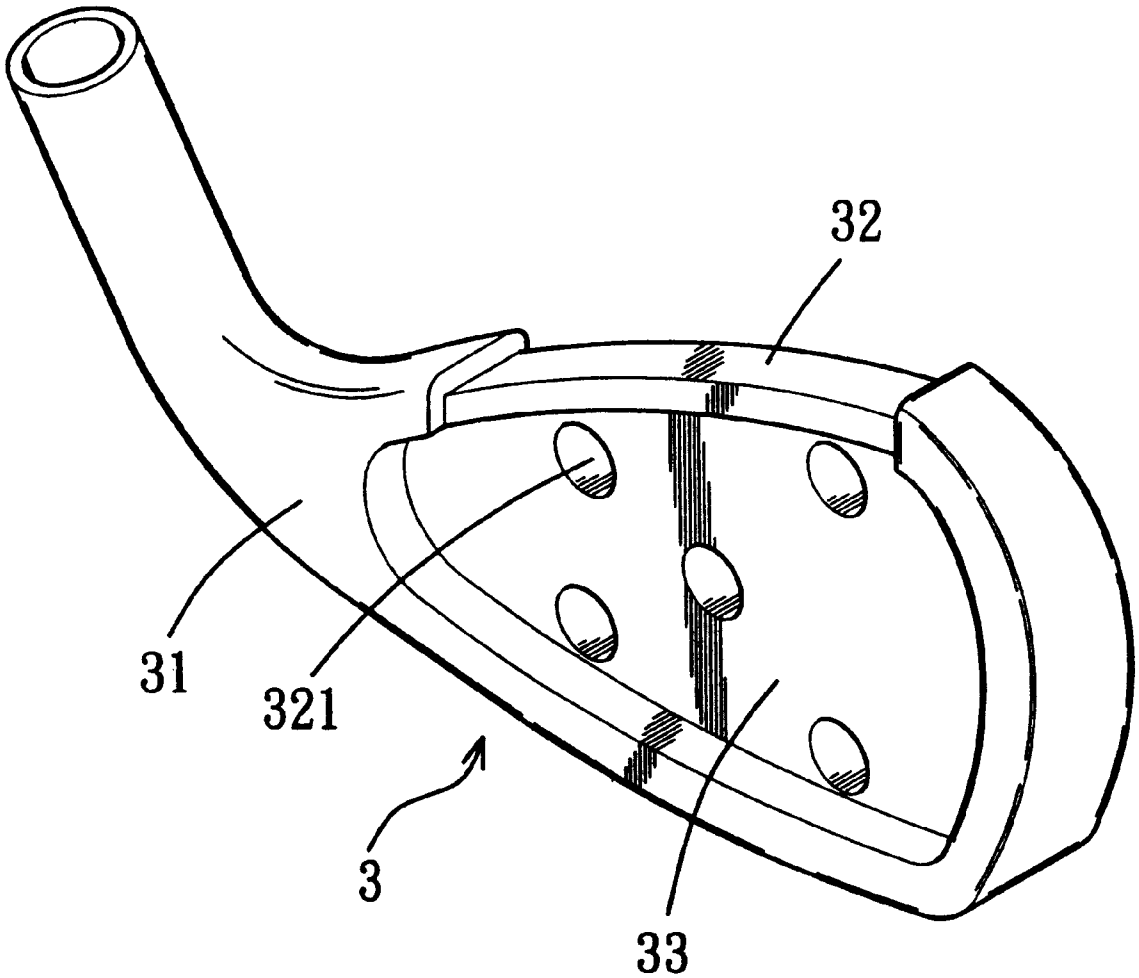
FIG. 5 is a rear view of the golf club head half completed in the present invention.
Figure 6:
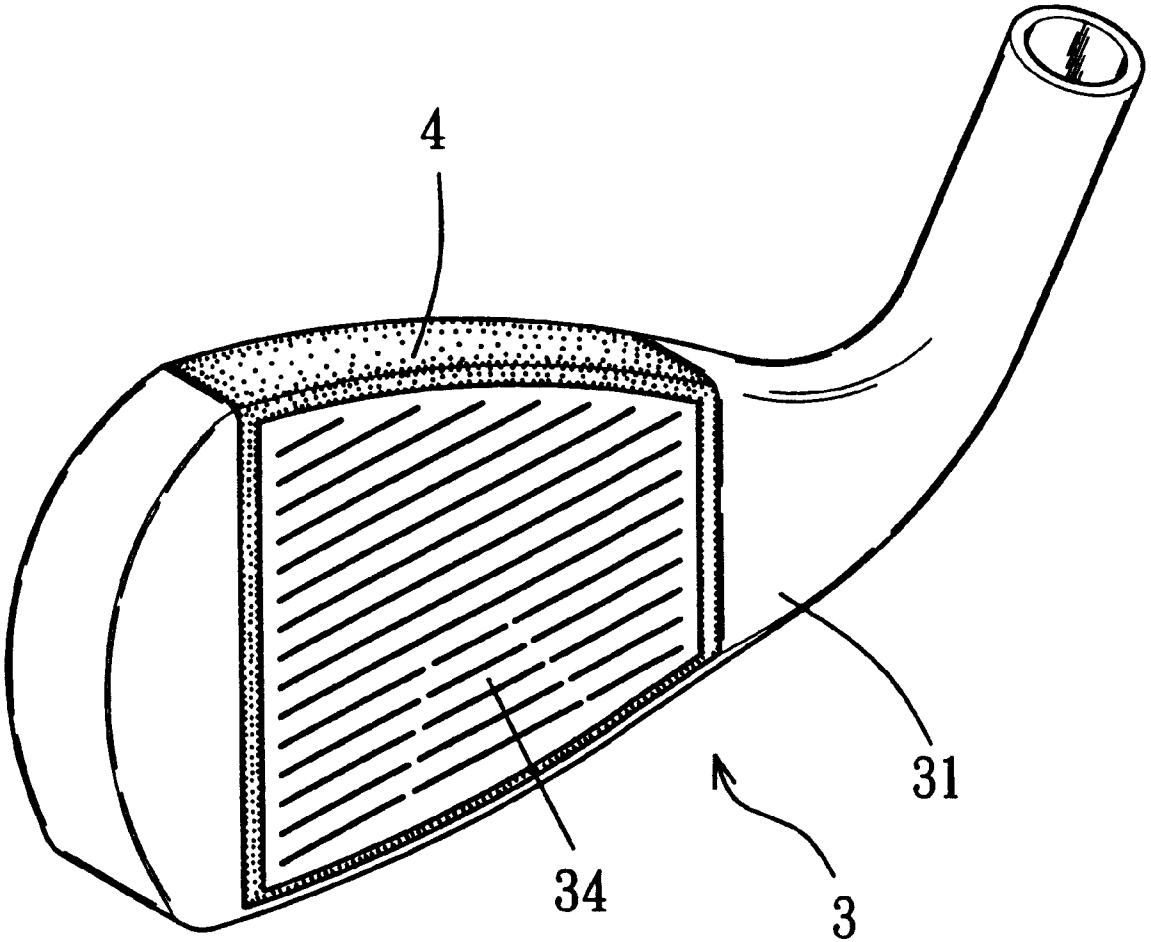
FIG. 6 is a front view of the golf club head in the present invention.

A preferred embodiment of a shock-absorbing golf club head in the present invention, as shown in FIGS. 4 and 5, includes a front recess 32 in the striking face of a golf club head, extending to the top and the rear portions of the striking face and communicating with a rear recess 33 by means of a plurality of through holes 321. Then, a shock-absorbing layer 4 is formed into shape and affixed to the front and the rear recesses 32 and 33, and a metal face plate 34 is fixedly mounted on the front recess 32, having a dented portion around its circumferential edge fixed with the striking face synchronously when the shock-absorbing layer 4 is formed and affixed to the front and the rear recess 32 and 33, as shown in FIGS. 6, 7, 8, and 9.

In addition, the shock-absorbing layer 4 is formed by compression with shock-absorbing material such as pure rubber or thermoplastic elastomers (so called TPE).

Figure 8:
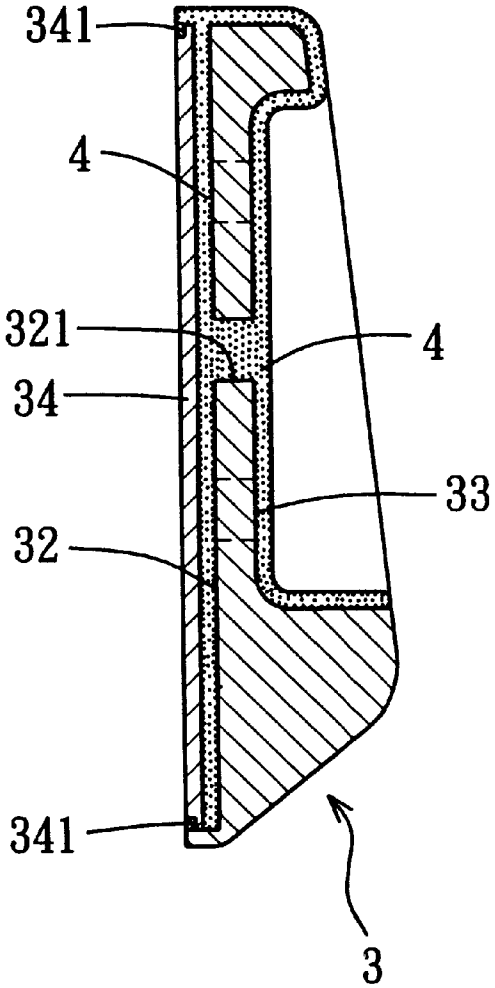
FIG. 8 is a vertical side cross-sectional view of the golf club head in the present invention.
Figure 7:
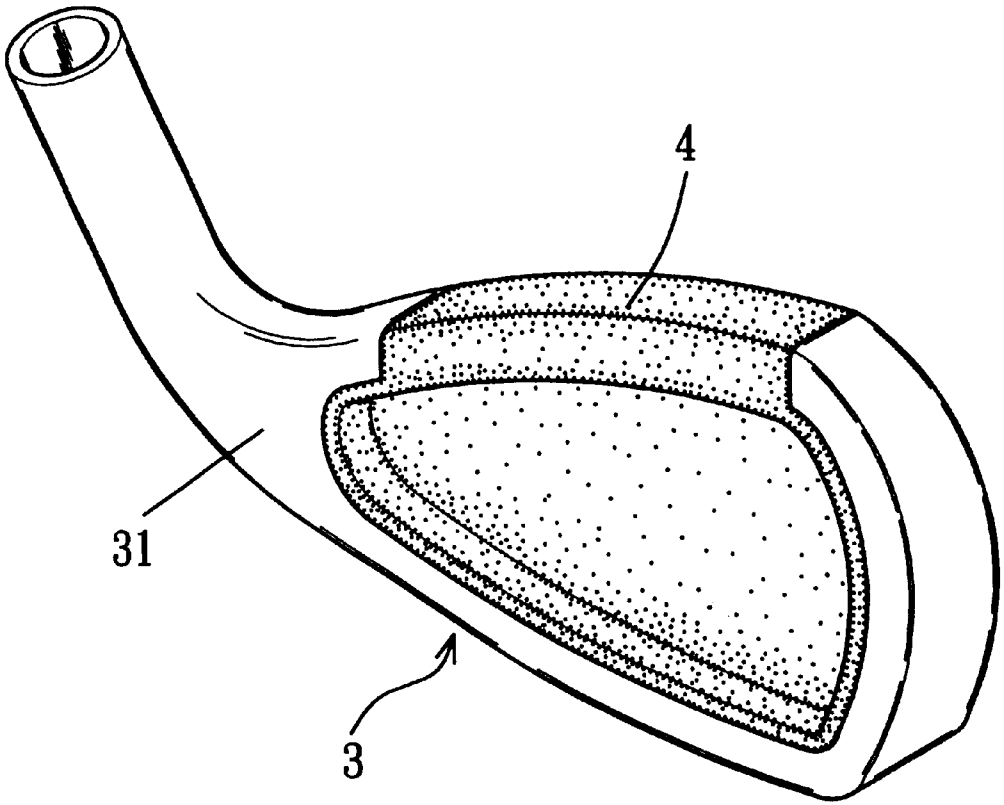
FIG. 7 is a rear view of the golf club head in present invention.
Figure 9:
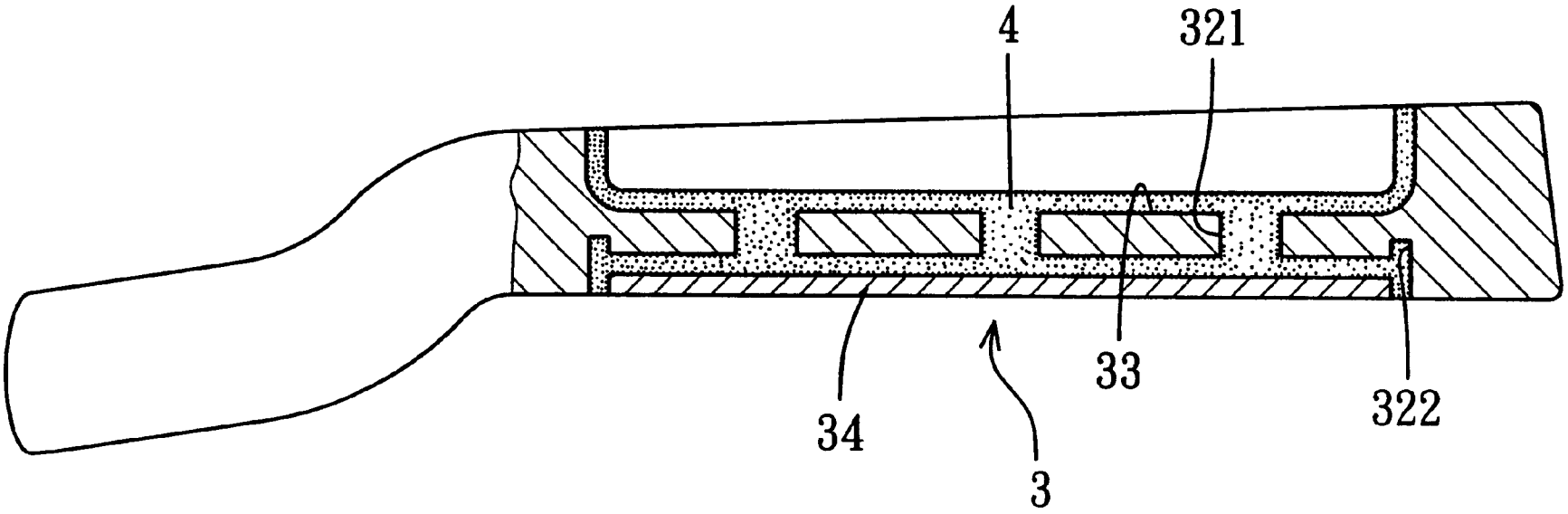
FIG. 9 is a horizontal side cross-sectional view of the golf club head in the present invention.

Further, FIG. 8 shows that the front and the rear recesses 32, 33 are respectively provided with a shock-absorbing layer 4 formed integrally to make up a double layer for shock-absorbing. With this design, the front shock-absorbing layer 4 in the striking face can directly absorb or lessen the wrench and shock force caused by hitting, and subsequently the rear shock-absorbing layer 4 in the rear recess 33 will completely absorb or eliminate the remaining shock force, thus obtaining an effectiveness of shock-absorbing, shock-lessening and stability of controlling balls.

While the preferred embodiment of the invention has been described above, it will be recognized and understood that various modifications may be made therein and the appended claims are intended to cover all such modifications that may fall within the spirit and scope of the invention.

I claim:

1. A shock-absorbing golf club head comprising:

at least four layers of materials, said layers including a metal face plate, a first shock-absorbing layer, a body of said golf club head, and a second shock-absorbing layer; wherein said body of said golf club head comprises a plurality of through holes, and said first and second shock absorbing layers are formed from a shock-absorbing material, said shock-absorbing material also fills said through holes in said body of said golf club head, an open space on a top side of said golf club head, and an open groove around a perimeter of said metal face plate; such that said shock-absorbing material is exposed on a front side of said golf club head around said perimeter of said metal face plate, said top side of said golf club head, and a rear side of said golf club head, said second shock-absorbing layer covering a majority of said rear side of said golf club head, and said first shock-absorbing layer is in physical contact with said second shock-absorbing layer, thereby maximizing a damping effect.

2. The golf-club head as claimed in claim 1, wherein:

said shock-absorbing material is a thermoplastic elastomer.

3. The golf-club head as claimed in claim 1, wherein:

said shock-absorbing material is rubber.

* * * * *